US006007435A

United States Patent [19]

Chern

[11] Patent Number: 6,007,435

[45] Date of Patent: Dec. 28, 1999

[54] STRUCTURE OF GOLF CLUB HEAD

[76] Inventor: Hong-Line Chern, No. 21, Lung Chiang Rd., Taipei City, Taiwan

[21] Appl. No.: 09/008,314

[22] Filed: Jan. 16, 1998

[51] Int. Cl.[6] ..... A63B 53/04

[52] U.S. Cl. ..... 473/342; 473/345; 473/349

[58] Field of Search ..... 473/324, 342, 473/345, 346, 349, 350, 329, 325, 330, 331

[56] References Cited

U.S. PATENT DOCUMENTS

| | | | |
|---|---|---|---|
| 1,494,494 | 5/1924 | Lippincott . | |
| 1,654,257 | 12/1927 | Hillerich . | |
| 3,847,399 | 11/1974 | Raymont | 473/342 |
| 4,930,781 | 6/1990 | Allen | 473/346 |
| 5,000,454 | 3/1991 | Soda | 473/346 |
| 5,451,058 | 9/1995 | Price | 473/346 |
| 5,711,722 | 1/1998 | Miyajima | 473/346 |
| 5,807,190 | 9/1998 | Krumme et al. . | |

*Primary Examiner*—Sebastiano Passaniti
*Attorney, Agent, or Firm*—Rosenberg, Klein & Lee

[57] ABSTRACT

A golf club head which includes a casing having an open chamber and a front opening at a front side thereof in communication with the open chamber, a mounting plate mounted inside the casing, and a plurality of high hardness metal rods fastened together by copper welding and perpendicularly mounted on the mounting plate inside the open chamber of the casing, the high hardness metal rods having a respective front end disposed in the front opening in flush with the casing and forming a striking face.

3 Claims, 3 Drawing Sheets

STRUCTURE OF GOLF CLUB HEAD

BACKGROUND OF THE INVENTION

The present invention relates to golf club heads, and more particularly to an improved structure of golf club head which has a high hardness striking face.

A regular golf club head is generally comprised of a casing, a metal face plate at a front side of the casing, and counterweights embedded in the casing. Because the hardness of the metal face plate is not very high, the striking face of the metal face plate absorbs a certain amount of impact force when hitting the ball. Because of this impact force absorption effect, less reactive force is given to the ball, and the player should employ much effort to drive the ball to the desired location.

SUMMARY OF THE INVENTION

It is the main object of the present invention to provide a golf club head which has a high hardness striking face, that produces a high reactive force when hitting the ball. It is another object of the present invention to provide a golfclub head which is practical and safe for the beginners and aged persons, and needs less effort to drive the ball to the desired location. To achieve these and other objects of the present invention, there is provided a golf club head comprised of a hollow casing, a mounting plate mounted inside the casing, and a plurality of high hardness metal rods fastened together by copper welding and perpendicularly mounted on the mounting plate inside the open chamber of the casing, the high hardness metal rods having a respective front end disposed in flush with a front open side of the casing and forming a striking face for hitting the ball.

DETAILED DESCRIPTION OF THE PREFERRED EMBODIMENT

Figure 2:
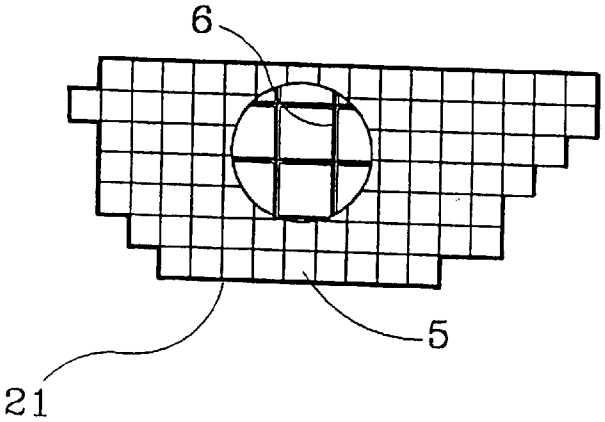
FIG. 2 is an enlarged view of the striking face according to the present invention.
Figure 1:
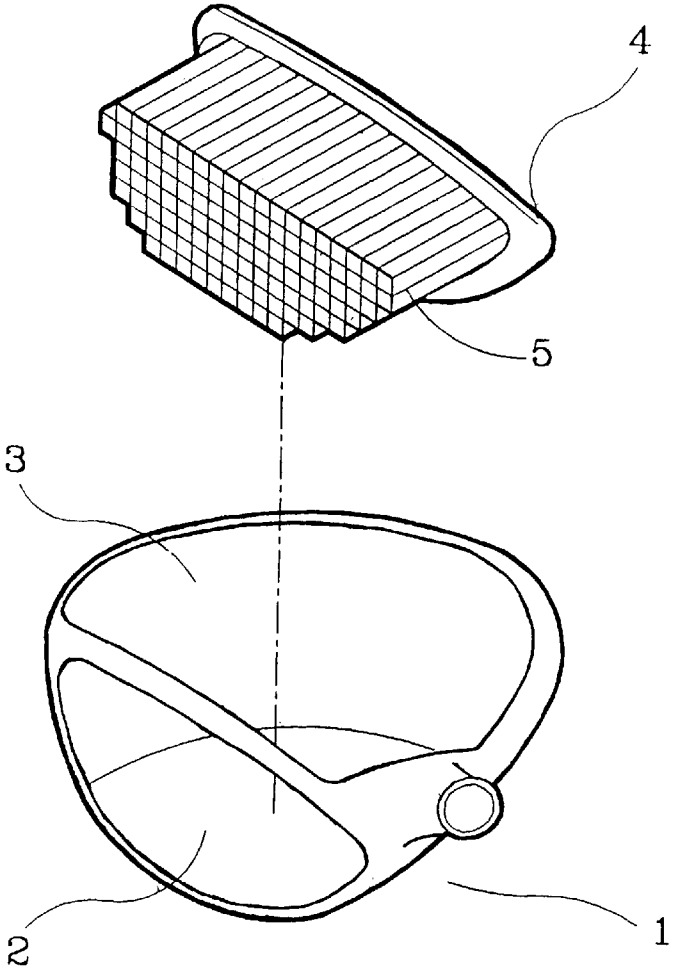
FIG. 1 is an exploded view of the present invention.
Figure 4:
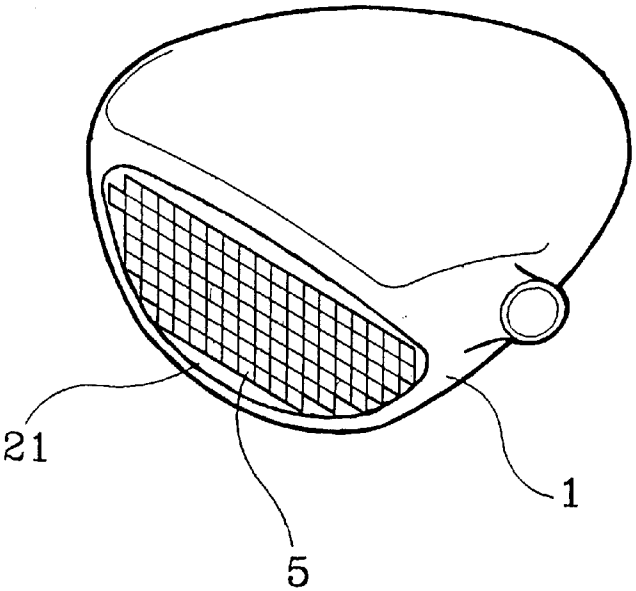
FIG. 4 is an elevational view of a finished golf club head according to the present invention.
Figure 3:
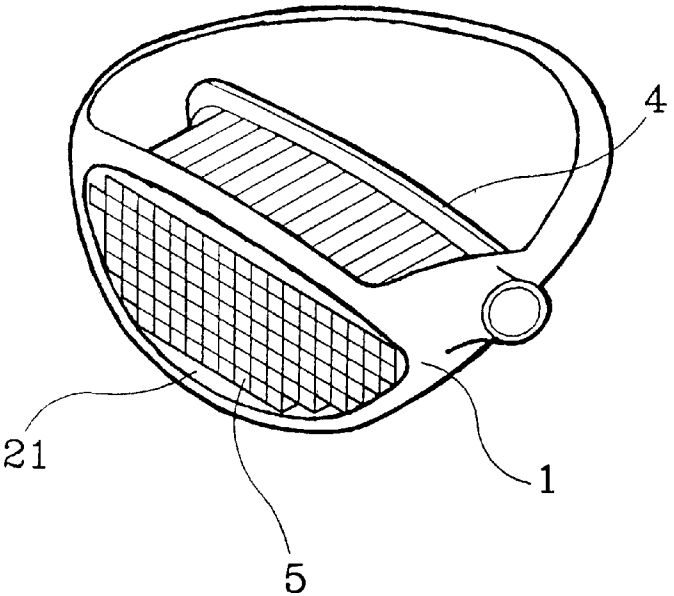
FIG. 3 shows the mounting plate with the high hardness metal rods mounted in the casing according to the present invention.

Referring to Figures from 1 to 4, a golf club head in accordance with the present invention is generally comprised of a casing 1, a mounting plate 4, and a plurality of high hardness metal rods 5.

The casing 1 comprises an open chamber 3, and a front opening 2. The high hardness metal rods 5 have a substantially square cross-sectional contour and are fastened together side by side by a bonding agent 6 or through a copper welding process, and then perpendicularly mounted on the mounting plate 4. When the high hardness metal rods 5 are fastened together and fixed to the mounting plate 4, the front ends (remote from the mounting plate 4) of the high hardness metal rods 5 are polished, so as to provide a striking face 21. The high hardness metal rods 5 with the mounting plate 4 as well as counterweights (not shown) are then put in the open chamber 3 of the casing 1, and then the casing 1, the high hardness metal rods 4 and the mounting plate 4 are cast into a finished golf club head, permitting the striking face 21 of the high hardness metal rods 5 to be disposed in the front opening 2 of the casing 1 in a flush manner. The high hardness metal rods 5 can be made from any alloy which has a hardness higher than tungsten carbide. High hardness materials may be fragile. However, the striking face 21 is strong against impact because it is formed by fastening a plurality of high hardness metal rods together. Because the striking face 21 is formed of high hardness metal, it produces a high reaction force when hitting the ball, so that the ball can be driven into the air higher and farther.

Figure 5:
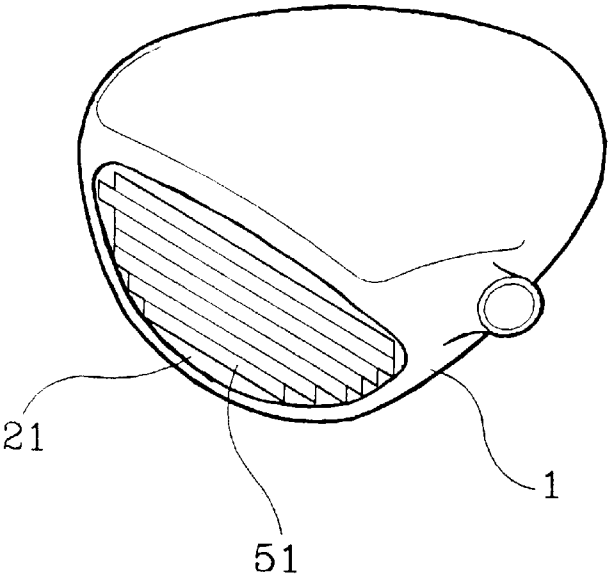
FIG. 5 shows an alternate form of the present invention.

FIG. 5 shows an alternate form of the present invention, in which the striking face 21 is formed of a plurality of high hardness metal rods 51 transversely arranged on a plane in flush with the front side of the casing 1.

Figure 6:
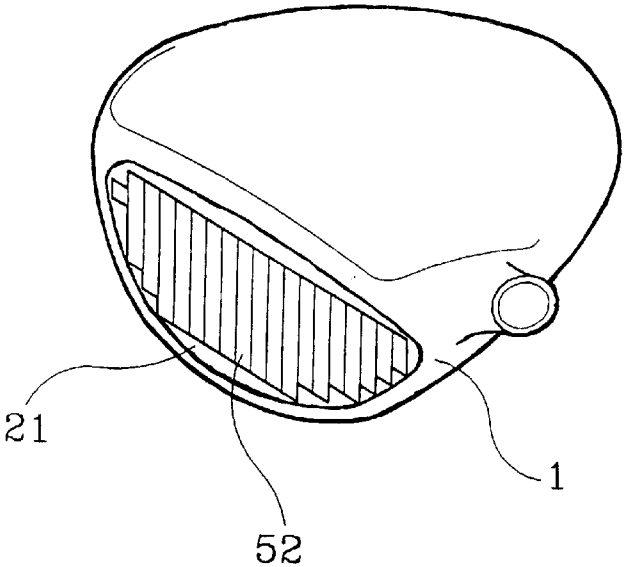
FIG. 6 shows another alternate form of the present invention.

FIG. 6 shows another alternate form of the present invention, in which the striking face 21 is formed of a plurality of high hardness metal rods 52 longitudinally arranged on a plane in flush with the front side of the casing 1.

It is to be understood that the drawings are designed for purposes of illustration only, and are not intended as a definition of the limits and scope of the invention disclosed. For example, the aforesaid mounting plate 4 may be eliminated, permitting the high hardness metal rods 5;51;52 to be directly molded in the casing 1.

What the invention claimed is:

1. A golf club head comprising:

a casing having an open chamber and an opening formed through a front side thereof in open communication with said open chamber; and a plurality of high hardness metal rods fastened together in side by side relationship and mounted inside said open chamber of said casing, each of said high hardness metal rods having a substantially square cross-sectional contour and a hardness higher than a hardness of said casing, said plurality of rods having a respective surface portion extending into said opening of said casing in a flush manner to form a striking face of said golf club head.

2. The golf club head of claim 1, wherein said high hardness metal rods have a respective rear end perpendicularly connected to a mounting plate mounted inside said open chamber of said casing, and a respective front end forming said striking face.

3. A golf club head comprising:

a casing having an open chamber and an opening formed through a front side thereof in open communication with said open chamber; and a plurality of high hardness metal rods fastened together in side by side relationship and mounted inside said open chamber of said casing, each of said high hardness metal rods having a hardness greater than tungsten carbide, said plurality of rods having a respective surface portion extending into said opening of said casing in a flush manner to form a striking face of said golf club head.

* * * * *